US009153191B2

(12) United States Patent
Ding et al.

(10) Patent No.: US 9,153,191 B2
(45) Date of Patent: Oct. 6, 2015

(54) POWER MANAGEMENT CIRCUIT AND GATE PULSE MODULATION CIRCUIT THEREOF CAPABLE OF INCREASING POWER CONVERSION EFFICIENCY

(75) Inventors: Zhen-Guo Ding, Tainan (TW); Wen-Hsin Cheng, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 506 days.

(21) Appl. No.: 13/369,302

(22) Filed: Feb. 9, 2012

(65) Prior Publication Data

US 2013/0113776 A1 May 9, 2013

(30) Foreign Application Priority Data

Nov. 9, 2011 (TW) ..... 100140870 A

(51) Int. Cl.
*G09G 3/36* (2006.01)

(52) U.S. Cl.
CPC ..... *G09G 3/3677* (2013.01); *G09G 2320/0247* (2013.01); *G09G 2330/021* (2013.01)

(58) Field of Classification Search
CPC ..... G09G 3/3677; G09G 2330/021; G09G 2320/0247
USPC ..... 345/87, 94, 212
See application file for complete search history.

(56) References Cited

U.S. PATENT DOCUMENTS

| | | | | |
|---|---|---|---|---|
| 2001/0033266 | A1* | 10/2001 | Lee | 345/94 |
| 2003/0006949 | A1* | 1/2003 | Sekiya et al. | 345/87 |
| 2005/0014473 | A1* | 1/2005 | Zhao et al. | 455/83 |
| 2008/0150871 | A1* | 6/2008 | Park | 345/98 |
| 2010/0289785 | A1* | 11/2010 | Sawabe | 345/208 |
| 2011/0084894 | A1* | 4/2011 | Siao et al. | 345/55 |
| 2012/0154360 | A1* | 6/2012 | Wu et al. | 345/211 |

FOREIGN PATENT DOCUMENTS

| | | |
|---|---|---|
| TW | 200517721 | 6/2005 |
| TW | 201110098 | 3/2011 |
| TW | 201123135 | 7/2011 |
| TW | 201137442 | 11/2011 |

* cited by examiner

*Primary Examiner* — Jonathan Blancha
(74) *Attorney, Agent, or Firm* — Winston Hsu; Scott Margo

(57) ABSTRACT

A power management circuit for a liquid crystal display device is disclosed. The power management circuit includes one or more power generating circuits, for receiving one or more input voltages and generating one or more output voltages, respectively; a gate pulse modulation circuit, coupled between a gate high-level voltage source and a discharging control terminal, for generating a gate control signal; and a discharging controller, coupled to the discharging control terminal, for providing a discharging path for the gate pulse modulation circuit, wherein one of the gate pulse modulation circuit and the discharging controller is further coupled to a power supply such that the gate pulse modulation circuit discharges to the power supply during a gate discharging period, and the power supply is one of the one or more input voltages and the one or more output voltages.

14 Claims, 11 Drawing Sheets

POWER MANAGEMENT CIRCUIT AND GATE PULSE MODULATION CIRCUIT THEREOF CAPABLE OF INCREASING POWER CONVERSION EFFICIENCY

BACKGROUND OF THE INVENTION

1. Field of the Invention

The present invention relates to a power management circuit and gate pulse modulation circuit thereof, and more particularly, to a power management circuit and gate pulse modulation circuit thereof capable of increasing power conversion efficiency.

2. Description of the Prior Art

In general, each of sub-pixels in a liquid crystal display (LCD) device includes a thin film transistor (TFT) and a liquid crystal capacitor. Since there is a parasitic capacitor appears between a gate and a source of the TFT, electric charges stored in the liquid crystal capacitor are subject to the coupling effect of the parasitic capacitor during a discharging period, which affects image data intended to display.

For example, please refer to FIG. 1, which is a schematic diagram of a sub-pixel 10 in a LCD device in the prior art. As shown in FIG. 1, the sub-pixel 10 includes a TFT 100 and a liquid crystal capacitor 102, wherein a parasitic capacitor $C_{GD}$ is between the gate and the source of the TFT 100. A timing controller of the LCD device performs timing control, such that a gate driving voltage of a scan line GL can turn on the TFT 100 during a gate high-level voltage VGH, and thus a data line SL can charge the liquid crystal capacitor 102 to a desirable voltage level to display image data. However, when the gate driving voltage of the scan line GL switches to a gate low-level voltage VGL to turn off the TFT 100, since the parasitic capacitor $C_{GD}$ is between the gate and the source of the TFT 100, voltage switching of the gate of the TFT 100 (i.e. switching from the gate high-level voltage VGH to the gate low-level voltage VGL) may couple to the source of the TFT 100 via the parasitic capacitor $C_{GD}$, and affect a voltage level stored in the liquid crystal capacitor 102, so as to affect image data intended to display.

In such a situation, please refer to FIG. 2A, which is a schematic diagram of reducing the coupling effect of the parasitic capacitor $C_{GD}$ shown in FIG. 1 in the prior art. As shown in FIG. 2A, compared with directly switching the scan line GL from the gate high-level voltage VGH to the gate low-level voltage VGL (as shown in the left part), in order to reduce the coupling effect of the parasitic capacitor CGD, during this conventional process of switching the scan line GL from the gate high-level voltage VGH to the gate low-level voltage VGL, the gate high-level voltage VGH is reduced to 0V with a discharging slope first, and then to the gate low-level voltage VGL (as shown in right part). As a result, instantaneous voltage variation across two terminals of the parasitic capacitor $C_{GD}$ is reduced, which effectively reduce the coupling effects from the gate of the TFT 100 to the source of the TFT 100.

In detail, please refer to FIG. 2B, which is a block diagram of a gate pulse modulation circuit 20 for realizing functions shown in the left part of FIG. 2A. As shown in FIG. 2B, the gate pulse modulation circuit 20 includes pins 200-206. the pin 200 receives a switch control signal VFLK (can be provided by the timing controller), the pin 202 receives the gate high-level voltage VGH, the pin 204 is coupled to a ground (0V) via a discharging resistor RE, and the pin 206 outputs a gate control signal VGHM for gates of TFTs of all sub-pixels in LCD device. An equivalent aggregate parasitic capacitor C_VGHM can be equivalent to a sum of parasitic capacitors between the gates and the sources of the TFTs of the all sub-pixels, and thus the gate control signal VGHM may simultaneously charge/discharge the equivalent aggregate parasitic capacitor C_VGHM.

In respect to the specific operations of the gate pulse modulation circuit 20, during a gate charging period, the switch control signal VFLK is at a high voltage level, so that the gate control signal VGHM is the gate high-level voltage VGH while charging the equivalent aggregate parasitic capacitor C_VGHM to the gate high-level voltage VGH. In addition, during a gate discharging period, the switch control signal VFLK is at a low voltage level, so that the gate control signal VGHM equals a voltage of the equivalent aggregate parasitic capacitor C_VGHM in the beginning, and the gate control signal VGHM discharges to 0V via the discharging resistor RE.

However, the gate pulse modulation circuit 20 in the prior art discharges the charges stored in the equivalent aggregate parasitic capacitor C_VGHM to ground during the gate discharging period, and thus the stored charges is not utilized efficiently.

SUMMARY OF THE INVENTION

A power management circuit and a gate pulse modulation circuit thereof are provided, capable of transferring parasitic charges stored in a parasitic capacitor to any one of input voltages or output voltages of a power management chip for recycling during a gate discharging period, to increase conversion efficiency of a power source.

In an embodiment, the present invention discloses a power management circuit for a liquid crystal display device. The power management circuit includes one or more power generating circuits, for receiving one or more input voltages and generating one or more output voltages, respectively; a gate pulse modulation circuit, coupled between a gate high-level voltage source and a discharging control terminal, for generating a gate control signal; and a discharging controller, coupled to the discharging control terminal, for providing a discharging path for the gate pulse modulation circuit, wherein one of the gate pulse modulation circuit and the discharging controller is further coupled to a power supply such that the gate pulse modulation circuit discharges to the power supply during a gate discharging period, and the power supply is one of the one or more input voltages and the one or more output voltages.

In another embodiment, the present invention discloses a power management circuit for a liquid crystal display device. The power management circuit includes one or more power generating circuits, a gate pulse modulation circuit and a discharging controller. The one or more power generating circuits, for receiving one or more input voltages and generating one or more output voltages, respectively. The gate pulse modulation circuit includes a charging switch, coupled between a gate high-level voltage source and a gate control terminal; and a discharging switch, coupled between the gate control terminal and a discharging control terminal. The discharging controller is coupled between the discharging control terminal and a power supply, for providing a discharging path for the gate pulse modulation circuit, wherein the power supply is one of the one or more input voltages and the one or more output voltages.

In further embodiment, the present invention discloses a gate pulse modulation circuit, for generating gate control signals of a liquid crystal display device. The gate pulse modulation circuit includes a charging switch, coupled between a gate high-level voltage source and a gate control signal output terminal; a current mirror, coupled between the gate control signal output terminal and a discharging control terminal; and a discharging switch, coupled between the current mirror and a power supply.

In further another embodiment, the present invention discloses a power management circuit. The power management circuit includes the gate pulse modulation circuit power management circuit of the above, and one or more power generating circuits, for receiving one or more input voltages and generating one or more output voltages, respectively.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
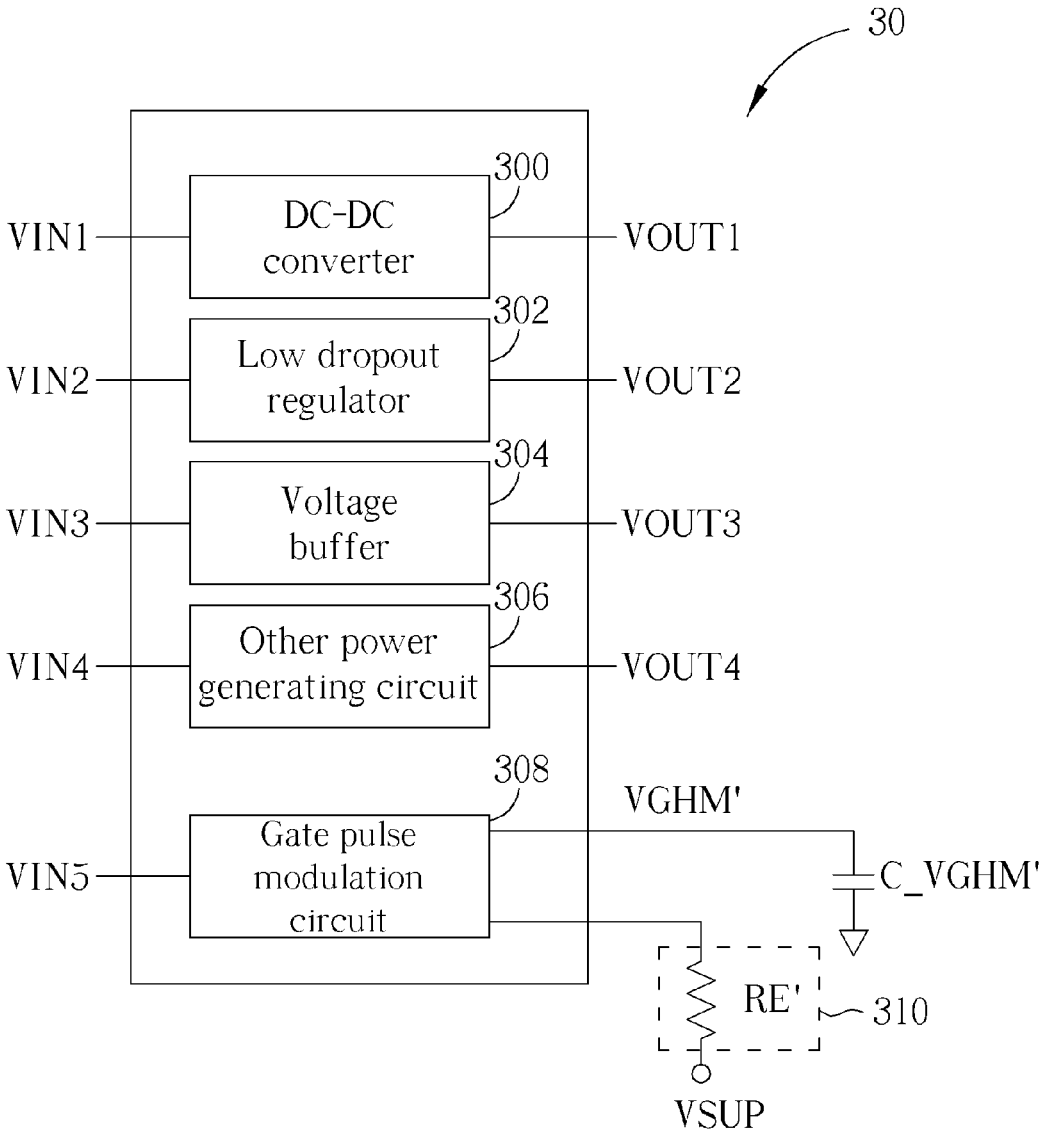
FIG. 3 is a schematic diagram of a power management circuit for a LCD device according to an embodiment.

Please refer to FIG. 3, which is a schematic diagram of a power management circuit 30 for a LCD device according to an embodiment. As shown in FIG. 3, the power management circuit 30, which can be implemented as a chip, includes a gate pulse modulation circuit 308, for receiving and modulating a gate high-level voltage source VIN5. A discharging controller 310 (e.g. realized by a discharging resistor RE') can be coupled between a discharging control terminal and a power supply (having a supply voltage VSUP), for providing a discharging path for the gate pulse modulation circuit 308. In addition, the power management circuit 30 further includes one or more power generating circuits, which are, for example, at least one of the following circuits: a DC-DC converter 300, a low dropout regulator 302, a voltage buffer 304, and one other power generating circuit 306, for receiving input voltages VIN1-VIN4, and providing output voltages VOUT1-VOUT4 according to the input voltages received by the circuits, respectively.

The main feature of the embodiment is that the power supply of the gate pulse modulation circuit 308 is chosen as one of the input voltages VIN1-VIN4 and the output voltages VOUT1-VOUT4. Under such a configuration, the gate pulse modulation circuit 308 can discharge a gate control signal VGHM' (i.e. the voltage of an equivalent aggregate parasitic capacitor C_VGHM') to the power supply via the discharging resistor RE' during a gate discharging period. Noticeably, the embodiment illustrates the discharging controller 310 disposed outside the power management circuit 30, but the discharging controller 310 can be disposed inside the power management circuit 30 in other embodiments.

Figure 1:
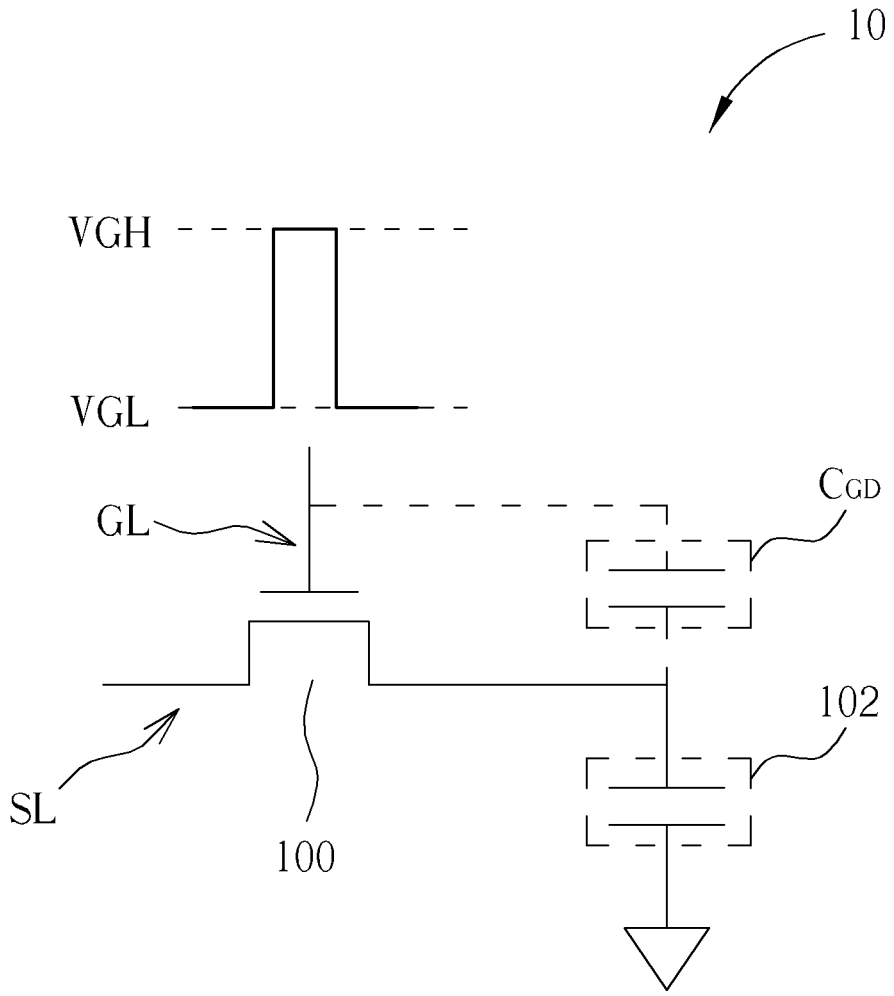
FIG. 1 PRIOR ART
FIG. 1 is a schematic diagram of a sub-pixel in a LCD device in the prior art.
Figure 2A:
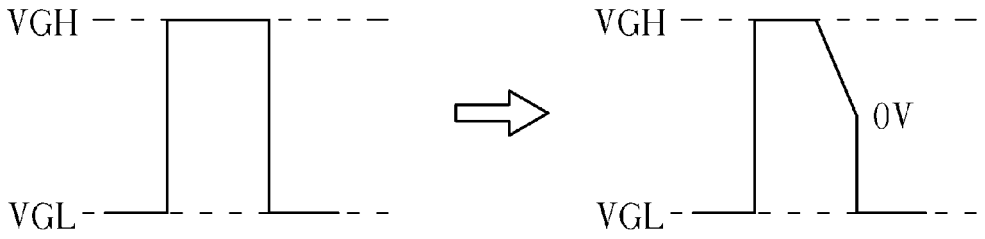
FIG. 2A PRIOR ART
FIG. 2A is a schematic diagram of reducing the coupling effect of a parasitic capacitor shown in FIG. 1 in the prior art.
Figure 2B:
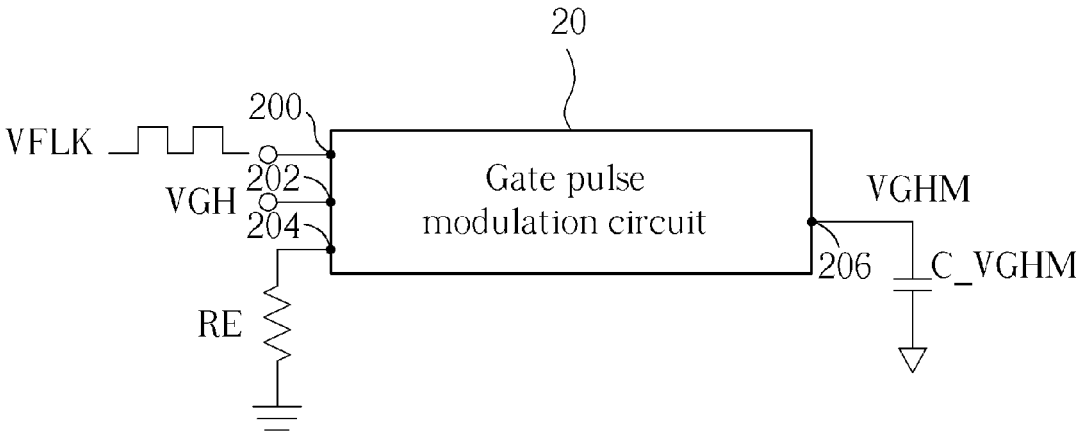
FIG. 2B PRIOR ART
FIG. 2B is a block schematic diagram of a gate pulse modulation circuit for realizing functions shown in the left part of FIG. 2A.

Compared with FIG. 2 where the gate pulse modulation circuit 20 shown in FIG. 2 is discharged to 0V during a gate discharging period and thus the charges stored in the equivalent aggregate parasitic capacitor C_VGHM can not be efficiently utilized, the discharging resistor RE' of the embodiment is coupled to the power supply, and the power supply is one of the input voltages VIN1-VIN4 and the output voltages VOUT1-VOUT4. Therefore, the embodiment can reduce the coupling effects from the gate to the source of the TFT of all sub-pixels in the LCD device, and also recycle the parasitic charges stored in the equivalent aggregate parasitic capacitor C_VGHM, which can increase power conversion efficiency without adding other voltage sources to provide the power supply.

Figure 4A:
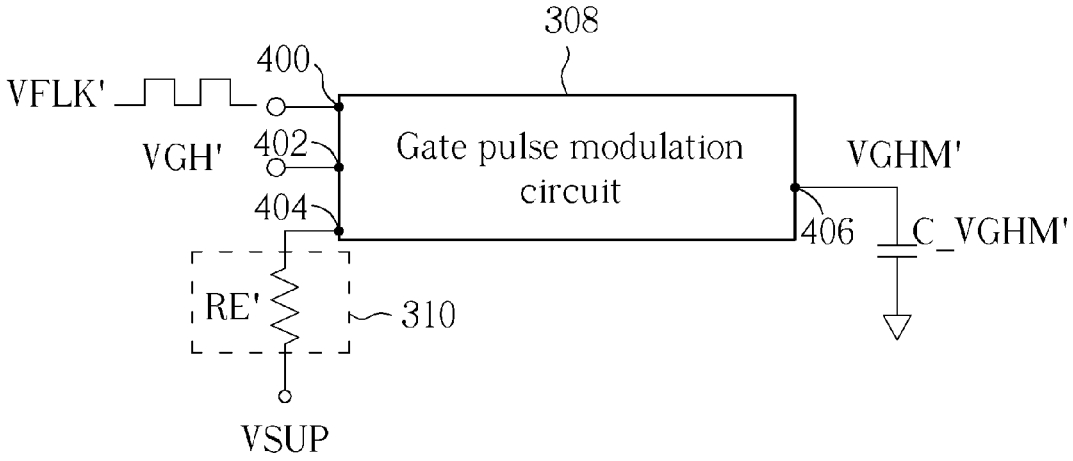
FIG. 4A is a block diagram of the gate pulse modulation circuit shown in FIG. 3 according to an embodiment.

In details, please refer to FIG. 4A, which is a block diagram of the gate pulse modulation circuit 308 shown in FIG. 3 according to an embodiment. As shown in FIG. 4A, the gate pulse modulation circuit 308 includes pins 400-406. The pin 400 receives a switch control signal VFLK' (can be provided by the timing controller), the pin 402 receives a gate high-level voltage VGH', the pin 404 is coupled to the supply voltage VSUP of the power supply via the discharging resistor RE', and the pin 406 outputs the gate control signal VGHM' for the gates of the TFTs of a plurality of (e.g. all sub-pixels) sub-pixels in LCD device. The equivalent aggregate parasitic capacitor C_VGHM' is equivalent to a sum of parasitic capacitors between the gates and the sources of the TFTs of the plurality of (e.g. all sub-pixels) sub-pixels, and thus the gate control signal VGHM' can simultaneously charge/discharge for the equivalent aggregate parasitic capacitor C_VGHM'. In addition, the gate high-level voltage VGH' can be regarded as the gate high-level voltage source VIN5 in FIG. 3. Under such a configuration, the gate control signal VGHM' is discharged to one of the input or the output voltage of the power management circuit 30. In other words, the charges stored (the switch control signal VFLK='HI') by the gate control signal VGHM' in storage stage is recycled for the one of the input or the output voltage of the power management circuit 30, which can increase conversion efficiency of the power management circuit 30.

Figure 4B:
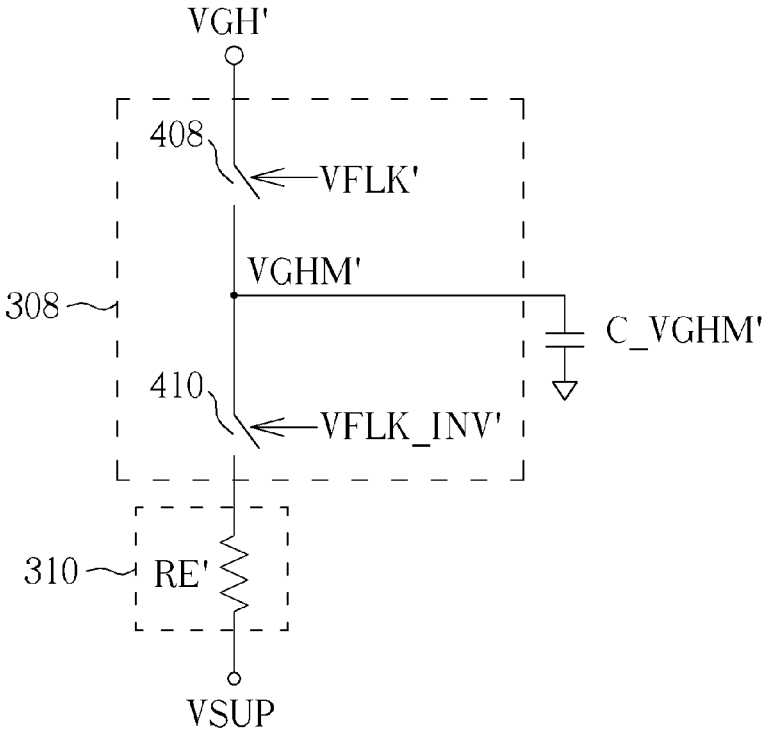
FIG. 4B is a circuit schematic diagram of the gate pulse modulation circuit shown in FIG. 4A according to an embodiment.
Figure 4C:
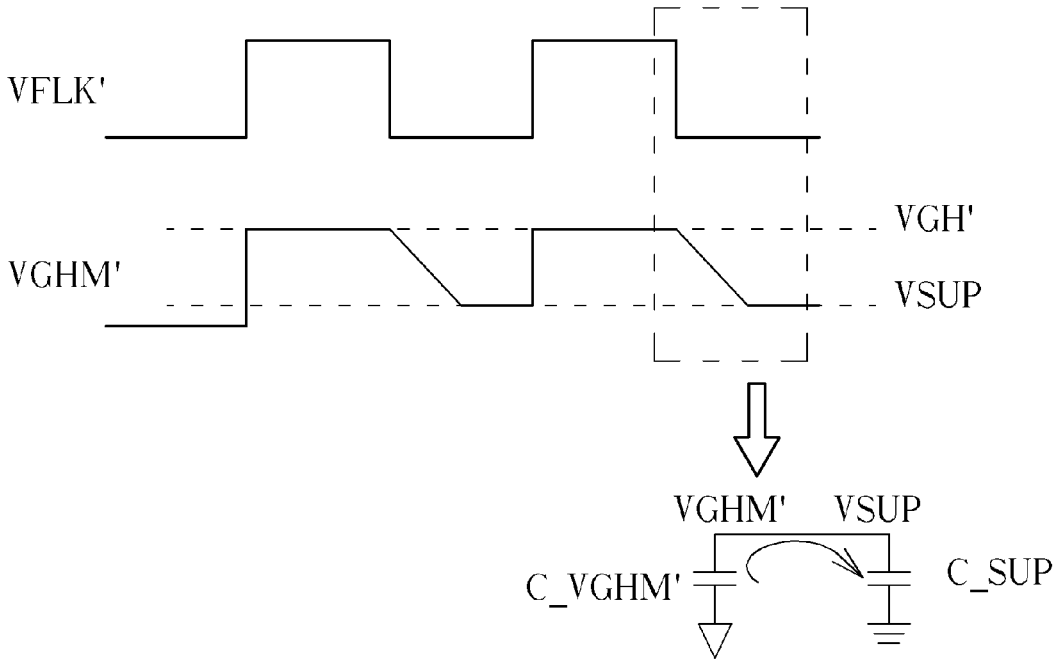
FIG. 4C is a schematic diagram of operations of the gate pulse modulation circuit shown in FIG. 4A according to an embodiment.

Specifically, please refer to FIG. 4B and FIG. 4C. FIG. 4B is a circuit diagram of the gate pulse modulation circuit 308 shown in FIG. 4A according to an embodiment, and FIG. 4C is a schematic diagram of operations of the gate pulse modulation circuit 308 shown in FIG. 4B according to an embodiment. As shown in FIG. 4B, the gate pulse modulation circuit 308 includes a charging switch 408 and a discharging switch 410. In addition, the discharging switch 410 is coupled to the power supply via the discharging controller 310 (e.g. the discharging resistor RE'). The charging switch 408 is coupled between a gate high-level voltage source (for providing the gate high-level voltage VGH') and the equivalent aggregate parasitic capacitor C_VGHM' (i.e. an output terminal of the gate control signal VGHM') of the LCD device. The discharging switch 410 is coupled between the equivalent aggregate parasitic capacitor C_VGHM' and the discharging control terminal. The discharging controller 310 is coupled between the discharging control terminal and the power supply, wherein the power supply is one of the input voltages VIN1-VIN4 and the output voltages VOUT1-VOUT4. In addition, the charging switch 408 and the discharging switch 410 are controlled by the switch control signal VFLK' and an inverted signal VFLK_INV' of the switch control signal VFLK', respectively.

In such a configuration, as shown in FIG. 4C, during a gate charging period, the switch control signal VFLK' is at a high voltage level and the inverted signal VFLK_INV' is at a low voltage level, and thus the charging switch 408 is turned on and the discharging switch 410 is turned off. Therefore, the gate control signal VGHM' is the gate high-level voltage VGH', and charges the equivalent aggregate parasitic capacitor C_VGHM' to the gate high-level voltage VGH' at the same time. Then, during a gate discharging period, the switch control signal VFLK' switches to a low voltage level and the inverted signal VFLK_INV' switches to a high voltage level, the charging switch 408 is turned off and the discharging switch 410 is turned on. Therefore, the gate control signal VGHM' is equal to the voltage previously stored in the equivalent aggregate parasitic capacitor C_VGHM' (i.e. the gate high-level voltage VGH') at the beginning, and then the equivalent aggregate parasitic capacitor C_VGHM' is discharged from the gate high-level voltage VGH' to the supply voltage VSUP via the discharging controller 310. In other words, in this stage, the parasitic charges stored in the equivalent aggregate parasitic capacitor C_VGHM' is transferred to a capacitor C_SUP of the power supply for storage.

Wherein during the gate discharging period, the gate control signal VGHM' (the voltage of the equivalent aggregate parasitic capacitor C_VGHM') is discharged from the gate high-level voltage VGH' to the supply voltage VSUP with a discharging slope decided by a capacitance of the equivalent aggregate parasitic capacitor C_VGHM' and a resistance of the discharging resistor RE'. Therefore, the discharging slope can be adjusted to achieve the effect intended to display by adjusting the resistance of the discharging resistor RE'. As a result, since the gate control signal VGHM' adjusts the discharging slope by the adjustable resistance, the voltage variation can be smaller, so as to effectively reduce the coupling effects from the gates to the sources of the TFTs of all subpixels. In addition, since the voltage supply is one of the input voltages VIN1-VIN4 and the output voltages VOUT1-VOUT4, the parasitic charges stored in the equivalent aggregate parasitic capacitor C_VGHM can be recycled, to increase the power conversion efficiency.

Figure 4D:
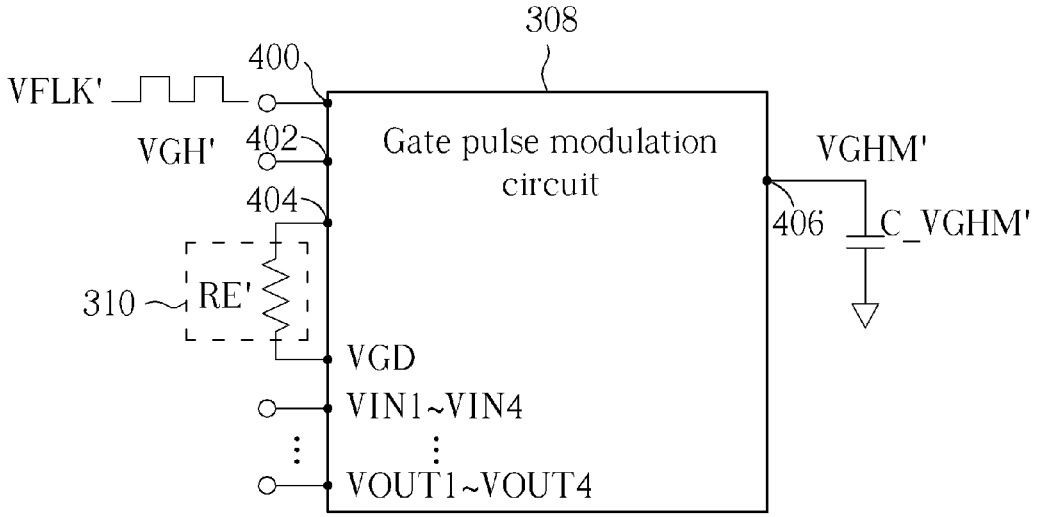
FIG. 4D is a block diagram of the gate pulse modulation circuit shown in FIG. 3 according to another embodiment.
Figure 4E:
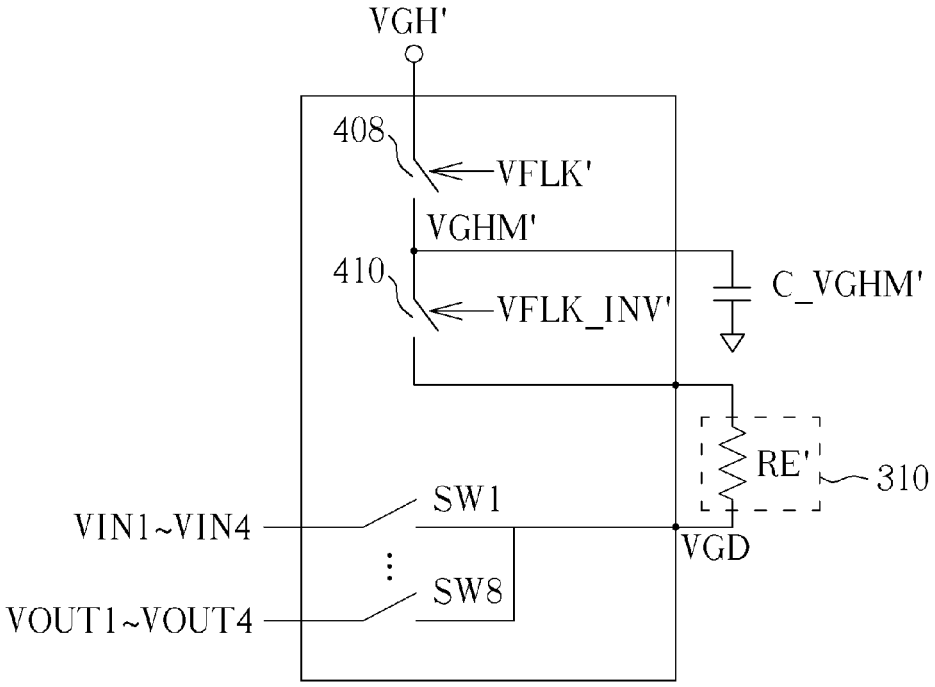
FIG. 4E is a circuit schematic diagram of the gate pulse modulation circuit shown in FIG. 4A according to another embodiment.

Please refer to FIG. 4D and FIG. 4E. FIG. 4D is a block diagram of the gate pulse modulation circuit 308 shown in FIG. 3 according to another embodiment. FIG. 4E is a circuit schematic diagram of the gate pulse modulation circuit 308 shown in FIG. 4A according to another embodiment. The main difference between FIG. 4D and FIG. 4A is that FIG. 4D further includes eight pins (also marked as VIN1-VIN4 and VOUT1-VOUT4) for receiving input voltage VIN1-VIN4 and the output voltage VOUT1-VOUT4, and include another pin VGD, coupled to the supply voltage VSUP, i.e. coupled to a terminal of the discharging controller 310. Please refer to FIG. 4E, the main difference between the circuits of FIG. 4E and FIG. 4B is that FIG. 4E further includes eight switches SW1-SW8, coupled between the pins VIN1-VIN4, VOUT1-VOUT4 and the pin VGD, respectively. The supply voltage VSUP can be selected as one of the input voltage VIN1-VIN4 and the output voltage VOUT1-VOUT4 by setting one of the switches SW1-SW8 to be turned on and the others to be turned off. For example, only one or more specific ones of the switches SW1-SW8 can be turned on. Alternatively, different ones of the switches SW1-SW8 can be turned on alternately in different periods. The advantage of the embodiment is that the switches can be disposed within the power management circuit 30 and a source of the supply voltage VSUP can be selected flexibly and easily without changing wire arrangements outside the power management circuit 30. The discharging slope still can be decided by the resistance of the discharging controller 310.

Noticeably, different variations of this embodiment can be implemented. For example, two or more switches may be disposed to be coupled to two or more of the input voltage VIN1-VIN4 and the output voltage VOUT1-VOUT4, respectively. Moreover, the switches and the pins, instead of being disposed within the gate pulse modulation circuit 308, may also be disposed outside the gate pulse modulation circuit 308 but still without the power management circuit 30.

Noticeably, the spirit of the above embodiments is to discharge the gate control signal VGHM' (i.e. the voltage of the equivalent aggregate parasitic capacitor C_VGHM') to the power supply during the gate discharging period, wherein the power supply is one of the input voltages VIN1-VIN4 and the output voltages VOUT1-VOUT4 of the power management circuit 30, and thus the parasitic charges stored in the equivalent aggregate parasitic capacitor C_VGHM can be recycled, to increase the power conversion efficiency. Those skilled in the art can make modifications or alterations accordingly. For example, the above embodiment illustrates that the power supply is connected outside a chip of the gate pulse modulation circuit 308 via the pin 404. However, the power supply can also be connected inside of the power management circuit 30 in practice. Besides, the power supply is not limited to one of the input voltages VIN1-VIN4 and the output voltages VOUT1-VOUT4 of the power management circuit 30, and can be other input voltages or output voltages of the power management circuit 30, and can also be one of the at least one input voltages and the at least one output voltages of a system application circuit, to provide recycling for the system application circuit. Moreover, realization of the discharging controller 310 is also not limited to the above embodiment, wherein the discharging controller 310 is implemented by the discharging resistor RE' coupled between the equivalent aggregate parasitic capacitor C_VGHM' and the power supply, and can be implemented with other methods, as long as the discharging controller 310 can control the discharging slope of the gate control signal VGHM' (i.e. the voltage of the equivalent aggregate parasitic capacitor C_VGHM') during the gate discharging period.

Figure 5A:
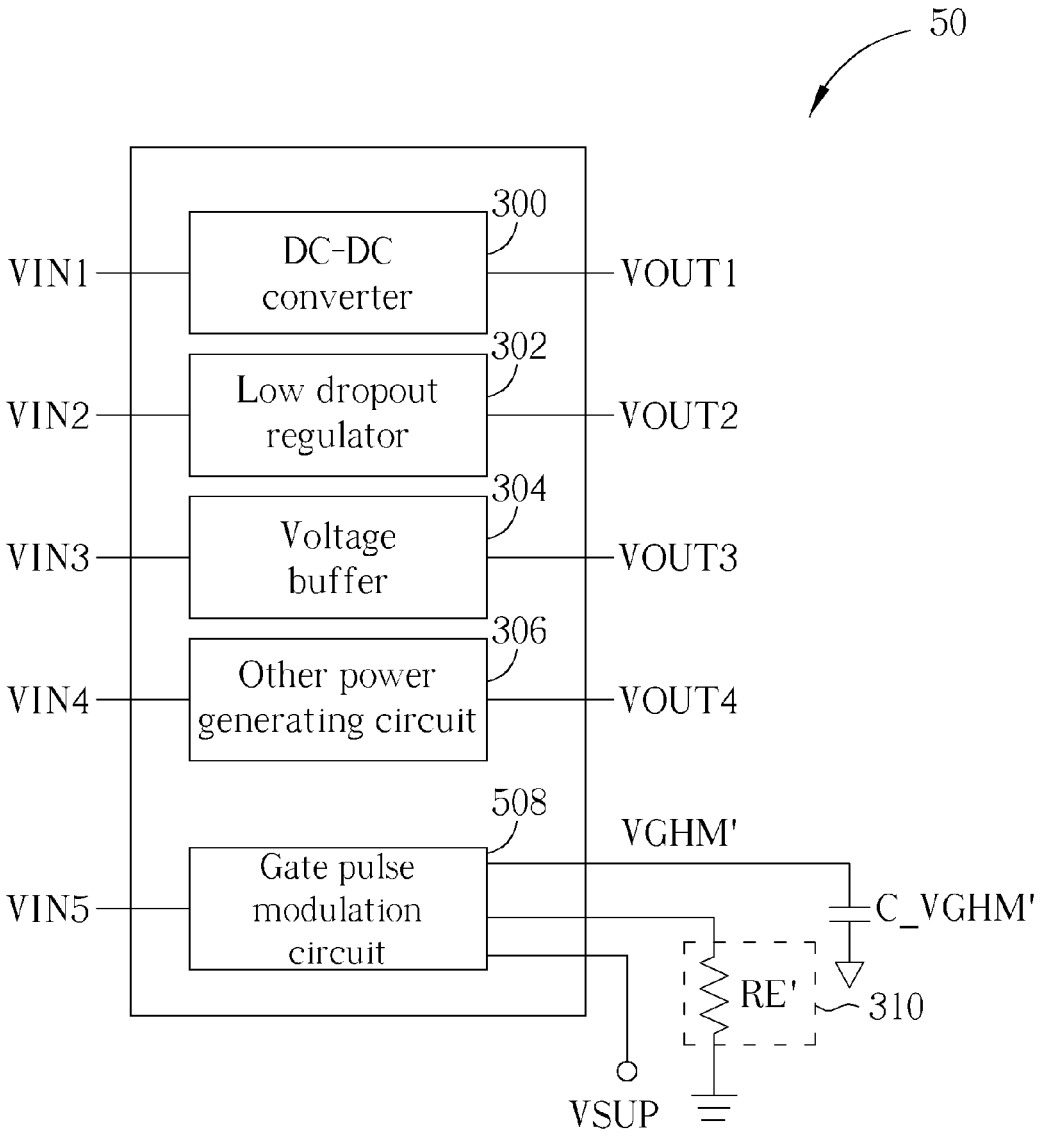
FIG. 5A is a schematic diagram of a power management circuit for a LCD device according to another embodiment.
Figure 5B:
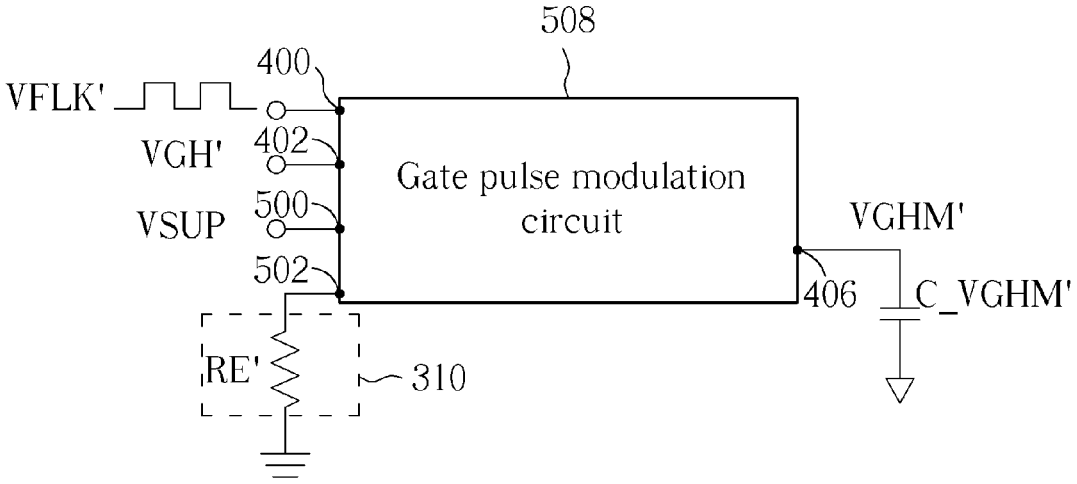
FIG. 5B is a block schematic diagram of a gate pulse modulation circuit shown in FIG. 5A according to an embodiment.
Figure 5C:
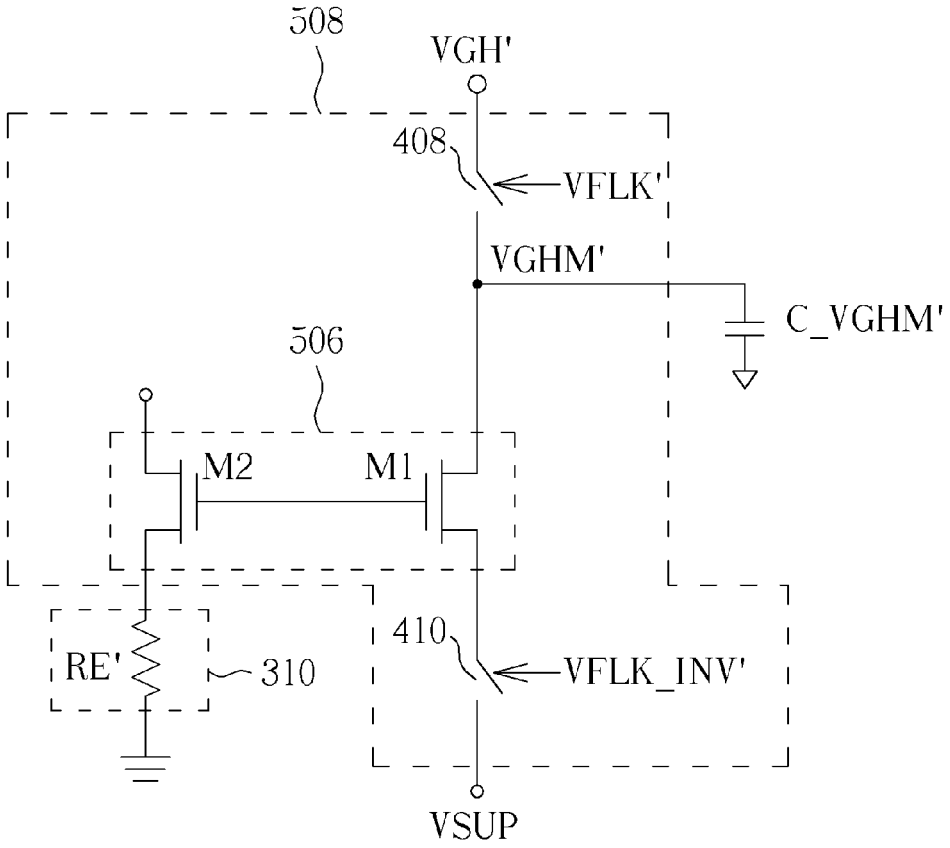
FIG. 5C is a circuit schematic diagram of the gate pulse modulation circuit shown in FIG. 5A according to an embodiment.
Figure 5D:
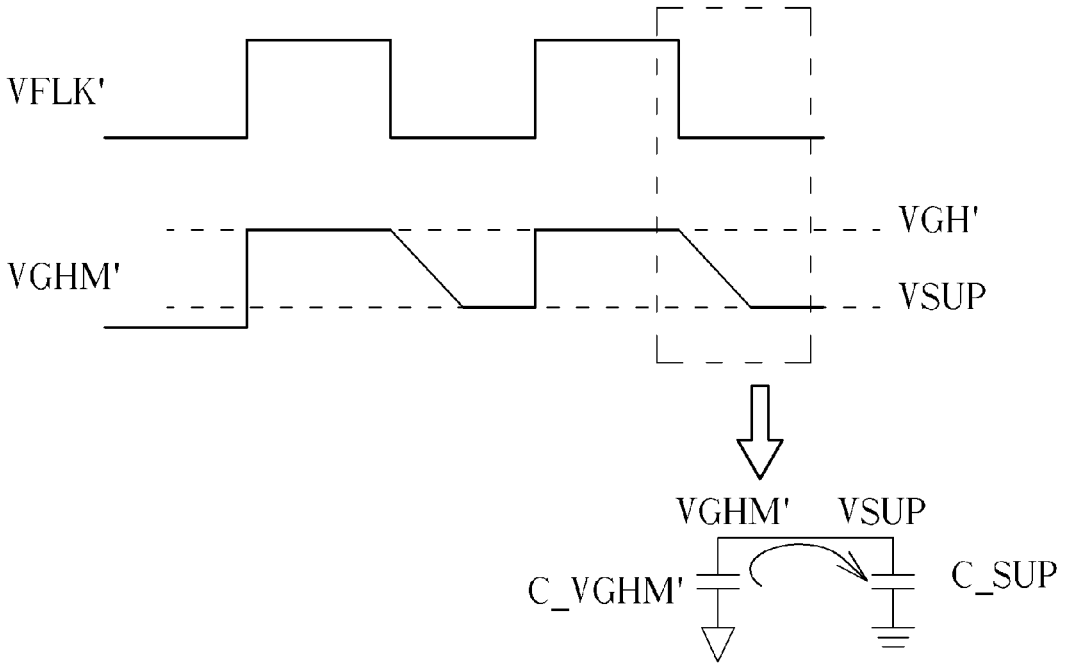
FIG. 5D is a schematic diagram of operations of the gate pulse modulation circuit shown in FIG. 5A according to an embodiment.

For example, please refer to FIG. 5A to FIG. 5D, FIG. 5A is a schematic diagram of another power management circuit 50 for a LCD device according to another embodiment. FIG. 5B is a block diagram of a gate pulse modulation circuit 508 shown in FIG. 5A, FIG. 5C is a circuit diagram of the gate pulse modulation circuit 508 shown in FIG. 5A, and FIG. 5D is a schematic diagram of operations of the gate pulse modulation circuit 508 shown in FIG. 5A. The structure and operating principle of the power management circuit 50 and the gate pulse modulation circuit 508 are similar to those of the power management circuit 30 and the gate pulse modulation circuit 308, and the elements and the signals with the same functionality are denoted by the same symbols for simplicity. As shown in FIG. 5A and FIG. 5B, the main difference between the gate pulse modulation circuit 508 and the gate pulse modulation circuit 308 is that compared with the gate pulse modulation circuit 308 which couples the discharging resistor RE' to the supply voltage VSUP of the power supply (i.e. coupled to the power supply via the discharging controller 310) by the pin 404, the gate pulse modulation circuit 508 couples the discharging resistor RE' to ground (0V) via a pin 502, and further include a pin 500 coupled to the supply voltage VSUP of the power supply. In other words, the gate pulse modulation circuit 508 itself is coupled to the power supply. Noticeably, the embodiment illustrates the discharging controller 310 or the discharging resistor RE' is illustrated as disposed outside the power management circuit 50, but in other embodiments the discharging controller 310 or the discharging resistor RE' can be set inside.

In such a situation, as shown in FIG. 5C, which is a circuit implementation of the gate pulse modulation circuit 508 shown in FIG. 5B according to an embodiment. The structure of the gate pulse modulation circuit 508 is similar to the gate pulse modulation circuit 308, but further includes a current mirror 506 coupled between the equivalent aggregate parasitic capacitor C_VGHM' (i.e. the output terminal of the gate control signal VGHM') and the discharging control terminal. In other words, the gate pulse modulation circuit 508 includes a charging switch 408, which coupled between a gate high-level voltage source VGH' and an output terminal of the gate control signal VGHM' (outputting the gate control signal VGHM'), and a current mirror 506, coupled between the output terminal of the gate control signal VGHM' and a discharging control terminal (for coupling to a terminal of the discharging controller 310), and a discharging switch 410, coupled between the current mirror 506 and the power supply. In addition, the gate pulse modulation circuit 508 can be couple to a ground level via the discharging controller 310 (e.g. implemented with a discharging resistor RE') which is also coupled to the discharging control terminal, and coupled to the power supply via the discharging switch 410 at the same time.

In an embodiment, the current mirror 506 mirrors the discharging current from the parasitic capacitor C_VGHM' to generate another current flowing to the ground via the discharging control terminal. For example, the current mirror 506 includes transistors M1, M2, wherein a control terminal of the transistor M1 and a control terminal of the transistor M2 are coupled to each other. In addition, the transistor M1 is coupled between the equivalent aggregate parasitic capacitor C_VGHM' and the discharging switch 410, and the transistor M2 is coupled between a voltage and the discharging control terminal. Therefore, the transistor M1 is coupled to the voltage supply via the discharging switch 410, and the transistor M2 is coupled to the ground via the discharging resistor RE'. The current of the transistor M2 can be adjusted by adjusting a resistance of the discharging resistor RE', and thus the current of the transistor M1 is also changed, which can also achieve the effect of controlling the discharging slope of the gate control signal VGHM' (i.e. the voltage of the equivalent aggregate parasitic capacitor C_VGHM') during the gate discharging period. Other operations of the gate pulse modulation circuit 508 can be derived by referring the operations of the gate pulse modulation circuit 308, and are not narrated hereinafter.

Figure 5E:
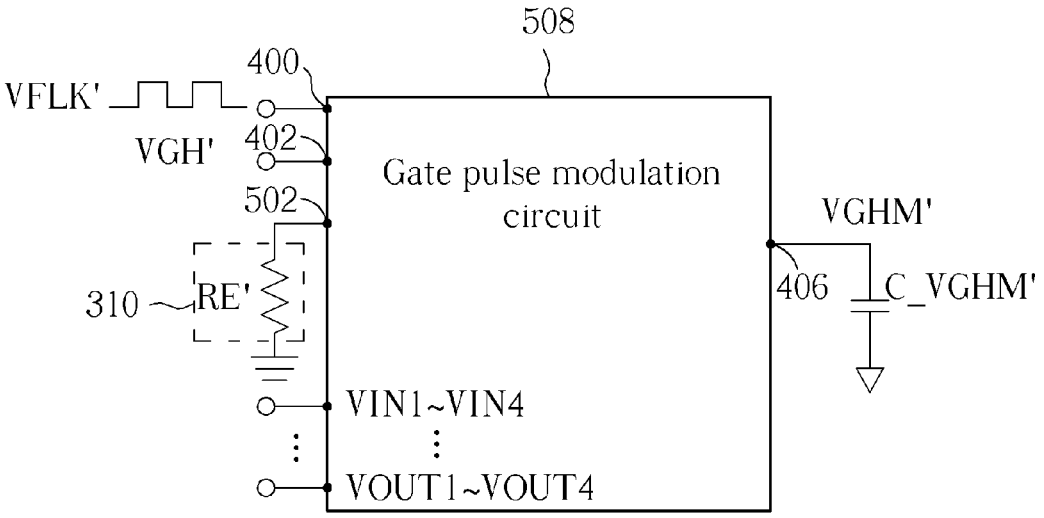
FIG. 5E is a block diagram of the gate pulse modulation circuit shown in FIG. 5A according to an embodiment.
Figure 5F:
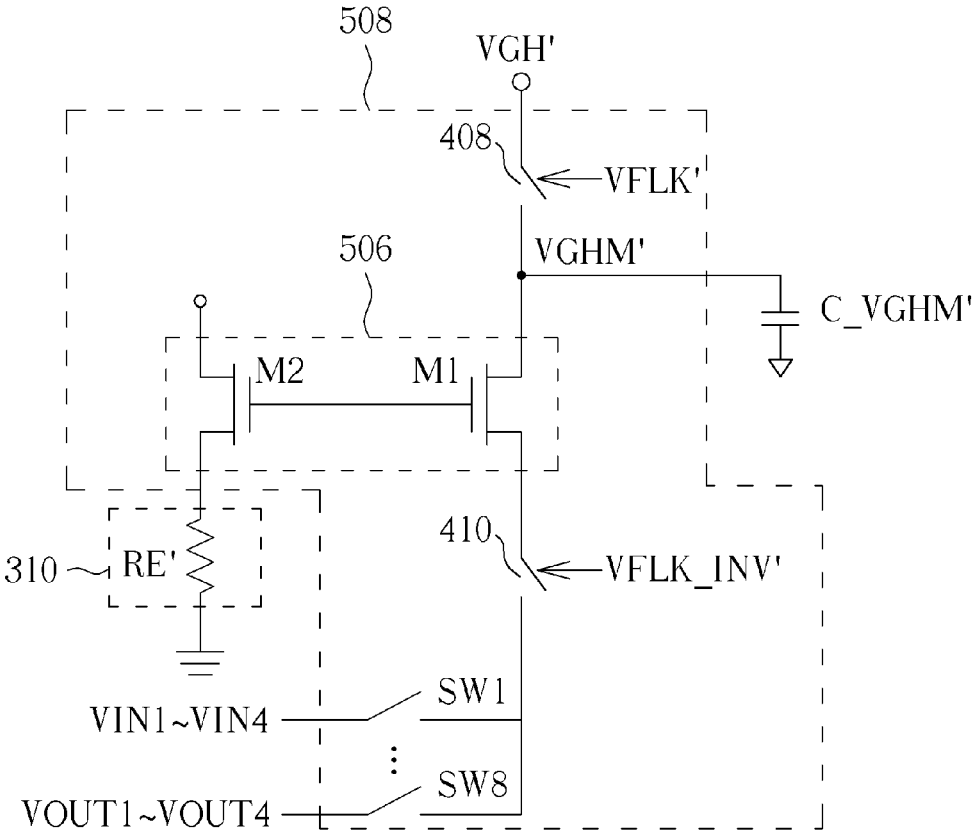
FIG. 5F is a circuit schematic diagram of the gate pulse modulation circuit shown in FIG. 5A according to an embodiment.

Please refer to FIG. 5E and FIG. 5F. FIG. 5E is a block diagram of the gate pulse modulation circuit 508 shown in FIG. 5A according to another embodiment. FIG. 5F is a circuit schematic diagram of the gate pulse modulation circuit 508 shown in FIG. 5A according to another embodiment. The main difference between FIG. 5E and FIG. 5B is that FIG. 5E further includes eight pins (also marked as VIN1-VIN4 and VOUT1-VOUT4) for receiving input voltage VIN1-VIN4 and the output voltage VOUT1-VOUT4. Please refer to FIG. 5F, the main difference between the circuits of FIG. 5F and FIG. 5C is that FIG. 5F further includes eight switches SW1-SW8, coupled between the pins VIN1-VIN4, VOUT1-VOUT4 and the pin VGD, respectively. The supply voltage VSUP can be selected as one of the input voltage VIN1-VIN4 and the output voltage VOUT1-VOUT4 by setting one of the switches SW1-SW8 to be turned on and the others to be turned off. For example, only one or more specific ones of the switches SW1-SW8 can be turned on. Alternatively, different ones of the switches SW1-SW8 can be turned on alternately in different periods. The advantage of the embodiment is that the switches can be disposed within the power management circuit 50 and a source of the supply voltage VSUP can be selected flexibly and easily without changing wire arrangements outside the power management circuit 50. The discharging slope still can be decided by the resistance of the discharging controller 310.

Noticeably, different variations of this embodiment can be implemented. For example, two or more switches may be disposed to be coupled to two or more of the input voltage VIN1-VIN4 and the output voltage VOUT1-VOUT4, respectively. Moreover, the switches and the pins, instead of being disposed within the gate pulse modulation circuit 508, may also be disposed outside the gate pulse modulation circuit 508 but still without the power management circuit 50.

Figure 6:
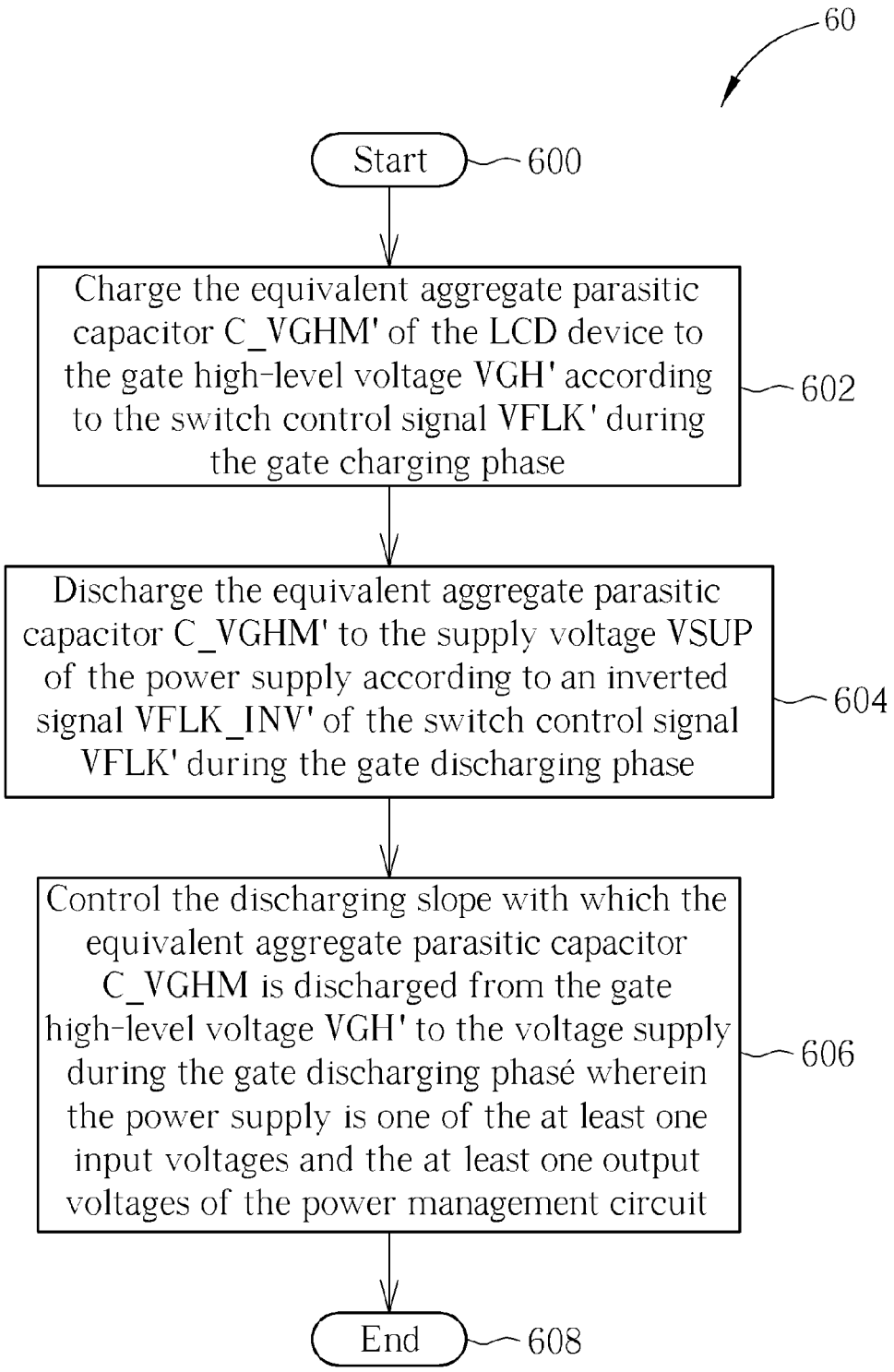
FIG. 6 is a schematic diagram of an electric charge recycling process according to an embodiment.

The operations of the gate pulse modulation circuit 308 and the gate pulse modulation circuit 508 can be summarized as an electronic charge recycling process 60 shown in FIG. 6. The electronic charge recycling process 60 includes following steps:

Step 600: Start.

Step 602: Charge the equivalent aggregate parasitic capacitor C_VGHM' of the LCD device to the gate high-level voltage VGH' according to the switch control signal VFLK' during the gate charging period.

Step 604: Discharge the equivalent aggregate parasitic capacitor C_VGHM' to the supply voltage VSUP of the power supply according to an inverted signal VFLK_INV' of the switch control signal VFLK' during the gate discharging period.

Step 606: Control the discharging slope with which the equivalent aggregate parasitic capacitor C_VGHM is discharged from the gate high-level voltage VGH' to the voltage supply during the gate discharging period; wherein the power supply is one of the at least one input voltages and the at least one output voltages of the power management circuit 30.

Step 608: End.

The details of the each step can be derived from the operations of the corresponding components of the gate pulse modulation circuit 308 and the gate pulse modulation circuit 508, and are not narrated hereinafter.

In the prior art, the gate pulse modulation circuit 20 discharges the charges stored in the equivalent aggregate parasitic capacitor C_VGHM to ground during the gate discharging period, so the stored charges cannot be utilized efficiently.

In comparison, the above embodiment discharges the gate control signal VGHM' (i.e. the voltage of equivalent aggregate parasitic capacitor C_VGHM') to the power supply during the gate discharging period, wherein the power supply is one of the input voltages VIN1-VIN4 and the output voltages VOUT1-VOUT4 of the power management circuit 30. Accordingly, the parasitic charges stored in the equivalent aggregate parasitic capacitor C_VGHM can be recycled, thus increasing the power conversion efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A power management circuit for a liquid crystal display device, comprising:

one or more power generating circuits, for receiving one or more input voltages and generating one or more output voltages, respectively;

a gate pulse modulation circuit, coupled between a gate high-level voltage source and a discharging control terminal, for generating a gate control signal; and a discharging controller, coupled to the discharging control terminal, for providing a discharging path for the gate pulse modulation circuit, wherein one of the gate pulse modulation circuit and the discharging controller is further coupled to a power supply such that the gate pulse modulation circuit discharges to the power supply to recycle discharges to the power supply for reutilization during a gate discharging period, and the power supply is one of the one or more input voltages and the one or more output voltages and is not a ground level.

2. The power management circuit of claim 1, wherein the gate pulse modulation circuit comprises:

a charging switch, coupled between the gate high-level voltage source and a gate control signal output terminal; and a discharging switch, coupled between the gate control signal output terminal and the discharging control terminal.

3. The power management circuit of claim 2, wherein the discharging controller is coupled between the discharging control terminal and the power supply.

4. The power management circuit of claim 1, wherein the gate pulse modulation circuit comprises:

a charging switch, coupled between the gate high-level voltage source and a gate control signal output terminal;

a current mirror, coupled between the gate control signal output terminal and the discharging control terminal; and a discharging switch, coupled between the current mirror and the power supply.

5. The power management circuit of claim 4, wherein the discharging controller is coupled between the discharging control terminal and a ground level.

6. The power management circuit of claim 4, wherein during a gate charging period, the charging switch is turned on and the discharging switch is turned off in responses to a first level of a switch control signal, to charge the gate control signal output terminal, and during the gate discharging period, the charging switch is turned off and the discharging switch is turned on in responses to second level of the switch control signal, to discharge voltage of the gate control signal output terminal to the power supply.

7. The power management circuit of claim 1, wherein the one or more power generating circuits comprises at least one of a DC-DC converter, a low dropout regulator and a voltage buffer.

8. The power management circuit of claim 1, wherein the discharging controller comprises a discharging resistor, coupled between the discharging control terminal and the power supply.

9. The power management circuit of claim 1, wherein the discharging controller comprises a discharging resistor, coupled between the discharging control terminal and a ground level.

10. The power management circuit of claim 1, further comprising a plurality of switches, coupled between the power supply, the one or more input voltages and the one or more output voltages, respectively.

11. A power management circuit for a liquid crystal display device, comprising:

one or more power generating circuits, for receiving one or more input voltages and generating one or more output voltages, respectively;

a gate pulse modulation circuit, comprising:

a charging switch, coupled between a gate high-level voltage source and a gate control terminal; and a discharging switch, coupled between the gate control terminal and a discharging control terminal; and a discharging controller, coupled between the discharging control terminal and a power supply, for providing a discharging path for the gate pulse modulation circuit to discharge to the power supply to recycle discharges to the power supply for reutilization during a gate discharging period, wherein the power supply is one of the one or more input voltages and the one or more output voltages and is not a ground level.

12. The power management circuit of claim 11, wherein the discharging controller comprises a discharging resistor, coupled between the discharging control terminal and the power supply.

13. The power management circuit of claim 11, wherein the one or more power generating circuits comprises at least one of a DC-DC converter, a low dropout regulator and a voltage buffer.

14. The power management circuit of claim 13, further comprising a plurality of switches, coupled between the power supply, the one or more input voltages and the one or more output voltages, respectively.

* * * * *